US011205365B1

(12) United States Patent
Leong

(10) Patent No.: US 11,205,365 B1
(45) Date of Patent: Dec. 21, 2021

(54) IMAGE DISPLAY SYSTEM AND IMAGE DATA TRANSMISSION APPARATUS AND METHOD THEREOF HAVING SYNCHRONOUS DATA TRANSMISSION MECHANISM

(71) Applicant: REALTEK SEMICONDUCTOR CORPORATION, Hsinchu (TW)

(72) Inventor: Pui-Kei Leong, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/213,274

(22) Filed: Mar. 26, 2021

(30) Foreign Application Priority Data

Jun. 19, 2020 (TW) ..... 109120882

(51) Int. Cl.
*G09G 3/20* (2006.01)

(52) U.S. Cl.
CPC ..... *G09G 3/20* (2013.01); *G09G 2310/08* (2013.01); *G09G 2360/06* (2013.01)

(58) Field of Classification Search
CPC .. G09G 3/20; G09G 2360/06; G09G 2310/08; G09G 2310/0289; G09G 2310/0291; G09G 2310/027; G09G 2370/08
See application file for complete search history.

(56) References Cited

U.S. PATENT DOCUMENTS 6,608,703 B1 * 8/2003 Toriyama ..... H04N 1/36 358/409
9,472,133 B2 10/2016 Kim et al.
10,297,192 B2 5/2019 Lee et al.
(Continued)

FOREIGN PATENT DOCUMENTS

TW 201327540 A 7/2013
TW 201426692 A 7/2014
TW 201824238 A 7/2018

OTHER PUBLICATIONS

OA letter of the counterpart TW application (appl No. 109120882) mailed on Jun. 29, 2021. Summary of the OA letter 1. Claims 1, 9 abd 10 are rejected as being unpatentable over the disclosure of the cited reference 1 (TW 201327540 A), the cited reference 2 (TW 201426692 A) and the cited reference 3 (TW 201824238 A). 2. Claims 2~8 are allowable.

*Primary Examiner* — Abbas I Abdulselam
(74) *Attorney, Agent, or Firm* — WPAT, PC

(57) ABSTRACT

The present disclosure discloses an image data transmission apparatus having synchronous data transmission mechanism. Output stage circuits respectively receive and store image data corresponding to a part of a display frame. A primary switch circuit is coupled to a primary output stage circuit of the output stage circuits so as to maintain a control voltage of a control terminal at a first level when a primary frame aligning signal having the latest timing is not received from the primary output stage circuit, and switches the control voltage to a second level when the primary frame aligning signal is received. The output stage circuits output the image data to an image data receiving apparatus to display the display frame synchronously when the output stage circuits receive the control voltage having the second level through voltage transmission paths having the same signal transmission time.

20 Claims, 4 Drawing Sheets

(56) References Cited

U.S. PATENT DOCUMENTS

| | | | | |
|---|---|---|---|---|
| 2011/0148838 | A1* | 6/2011 | Liang | H03K 19/018514 345/211 |
| 2011/0169808 | A1* | 7/2011 | Son | G09G 3/20 345/211 |
| 2014/0176515 | A1 | 6/2014 | Ko et al. | |

* cited by examiner

IMAGE DISPLAY SYSTEM AND IMAGE DATA TRANSMISSION APPARATUS AND METHOD THEREOF HAVING SYNCHRONOUS DATA TRANSMISSION MECHANISM

BACKGROUND OF THE INVENTION

1. Field of the Invention

The present disclosure relates to an image display system and an image data transmission apparatus and an image data transmission method thereof having synchronous data transmission mechanism.

2. Description of Related Art

Some consumer electronics products, e.g. smart TVs and smart phones, become popular since these products provide various types of entertaining contents. As a result, the performance requirement of these products becomes higher and higher. Take the liquid crystal display (LCD) television as an example, a large size panel usually offers a better viewing experience. Therefore, televisions are gradually developed to have larger and larger panel sizes, e.g. from 50 inches to 70 inches.

In a television with a large size panel, a multiple of image data transmission chips are required to provide image data corresponding to different areas of the panel such that the panel displays the image accordingly. However, such a design requires synchronous data transmission from the image data transmission chips to the panel. As a result, an accurate synchronous data transmission mechanism is necessary for the multiple of image data transmission chips and the panel, to allow the panel to receive and display the correct image data from the image data transmission chips.

SUMMARY OF THE INVENTION

In consideration of the problem of the prior art, an object of the present disclosure is to provide an image display system and an image data transmission apparatus and an image data transmission method thereof having synchronous data transmission mechanism.

The present disclosure discloses an image data transmission apparatus having synchronous data transmission mechanism that includes a plurality of output stage circuits, a primary switch circuit and a plurality of voltage transmission paths. Each of the output stage circuits is configured to receive and store one of a plurality of pieces of image data, wherein each of the pieces of image data corresponds to a part of a display frame. The primary switch circuit is electrically coupled to a primary output stage circuit of the output stage circuits, and is configured to maintain a control voltage of a control terminal at a first level when a primary frame aligning signal having a latest timing is not received thereby from the primary output stage circuit, and to switch the control voltage of the control terminal from the first level to a second level when the primary frame aligning signal is received. The plurality of voltage transmission paths are configured to electrically couple the control terminal to each of the output stage circuits and each of the voltage transmission paths has the same signal transmission time. When the output stage circuits receive the control voltage having the second level through the voltage transmission paths, the output stage circuits output the image data synchronously to an image data receiving apparatus such that the image data receiving apparatus displays the display frame accordingly.

The present disclosure also discloses an image display system that includes an image data receiving apparatus and an image data transmission apparatus. The image data transmission apparatus includes a plurality of output stage circuits, a primary switch circuit and a plurality of voltage transmission paths. Each of the output stage circuits is configured to receive and store one of a plurality of pieces of image data, wherein each of the pieces of image data corresponds to a part of a display frame. The primary switch circuit is electrically coupled to a primary output stage circuit of the output stage circuits, and is configured to maintain a control voltage of a control terminal at a first level when a primary frame aligning signal having a latest timing is not received thereby from the primary output stage circuit, and to switch the control voltage of the control terminal from the first level to a second level when the primary frame aligning signal is received. The plurality of voltage transmission paths are configured to electrically couple the control terminal to each of the output stage circuits and each of the voltage transmission paths has the same signal transmission time. When the output stage circuits receive the control voltage having the second level through the voltage transmission paths, the output stage circuits output the image data synchronously to the image data receiving apparatus such that the image data receiving apparatus displays the display frame accordingly.

The present disclosure further discloses an image data transmission method having synchronous data transmission mechanism applicable to an image data transmission apparatus, and includes the steps outlined below. One of a plurality of pieces of image data is received and stored by each of a plurality of output stage circuits, wherein each of the pieces of image data corresponds to a part of a display frame. A control voltage of a control terminal is maintained at a first level when a primary frame aligning signal having a latest timing is not received thereby from the primary output stage circuit by a primary switch circuit electrically coupled to a primary output stage circuit of the output stage circuits. The control voltage of the control terminal is switched from the first level to a second level when the primary frame aligning signal is received by the primary switch circuit. The image data is outputted synchronously to an image data receiving apparatus by the output stage circuits when the output stage circuits receive the control voltage having the second level through a plurality of voltage transmission paths such that the image data receiving apparatus displays the display frame accordingly, wherein the voltage transmission paths are configured to electrically couple the control terminal to each of the output stage circuits and each of the voltage transmission paths has the same signal transmission time.

These and other objectives of the present disclosure will no doubt become obvious to those of ordinary skill in the art after reading the following detailed description of the preferred embodiments that are illustrated in the various figures and drawings.

DETAILED DESCRIPTION OF THE PREFERRED EMBODIMENTS

An aspect of the present invention is to provide an image display system and an image data transmission apparatus and an image data transmission method thereof having synchronous data transmission mechanism, wherein a primary switch circuit is used to switch a voltage status of a control voltage according to a primary frame aligning signal having the latest timing such that the control voltage having the switched voltage status drives output stage circuits synchronously to output image data. An accurate synchronous image data transmission mechanism can be accomplished.

Figure 1:
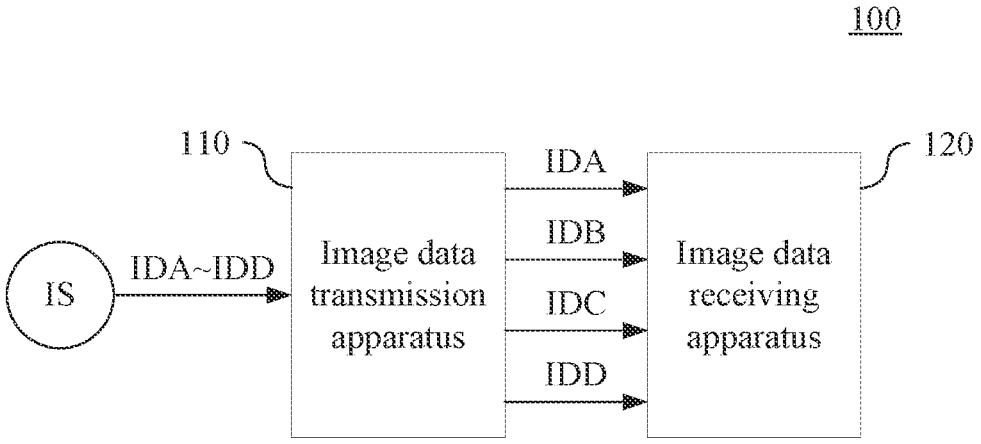
FIG. 1 illustrates a block diagram of an image display system according to an embodiment of the present invention.

Reference is now made to FIG. 1. FIG. 1 illustrates a block diagram of an image display system 100 according to an embodiment of the present invention. The image display system 100 includes an image data transmission apparatus 110 having synchronous data transmission mechanism and an image data receiving apparatus 120.

In an embodiment, the image display system 100 is such as, but not limited to a television. The image data transmission apparatus 110 is a circuit configured to receive image data IDA~IDD from an image source IS to perform signal processing and transmission. The image data receiving apparatus 120 is a panel configured to receive and display the image data IDA~IDD.

Under the trend that the size of the panel becomes larger, the image data transmission apparatus 110 processes and transmits the plurality of pieces of image data IDA~IDD by using different internal circuits to the image data receiving apparatus 120 to be displayed. For example, when the display panel is divided into four different display areas from the leftmost side to the rightmost side, different pieces of the image data IDA~IDD correspond to the different display areas. For example, the image data IDA corresponds to a first display area (i.e. the area at the leftmost side of the panel) and the image data IDD corresponds to the fourth display area (i.e. the area at the rightmost side of the panel), while the other two pieces of image data correspond to the second and the third display areas respectively. It is appreciated that the number of the pieces of image data and the division of the display areas of the panel described above are merely an example. In other embodiments, the number of the pieces of image data corresponding to a frame can be any positive integer larger than 1, and the display areas of the panel can be divided by using different methods.

As a result, a synchronous data transmission mechanism is required for the image data transmission apparatus 110 such that the image data receiving apparatus 120 can receive and display the plurality of pieces of image data IDA-IDD according to the accurate timing. The image frame can thus be displayed correctly.

Figure 2:
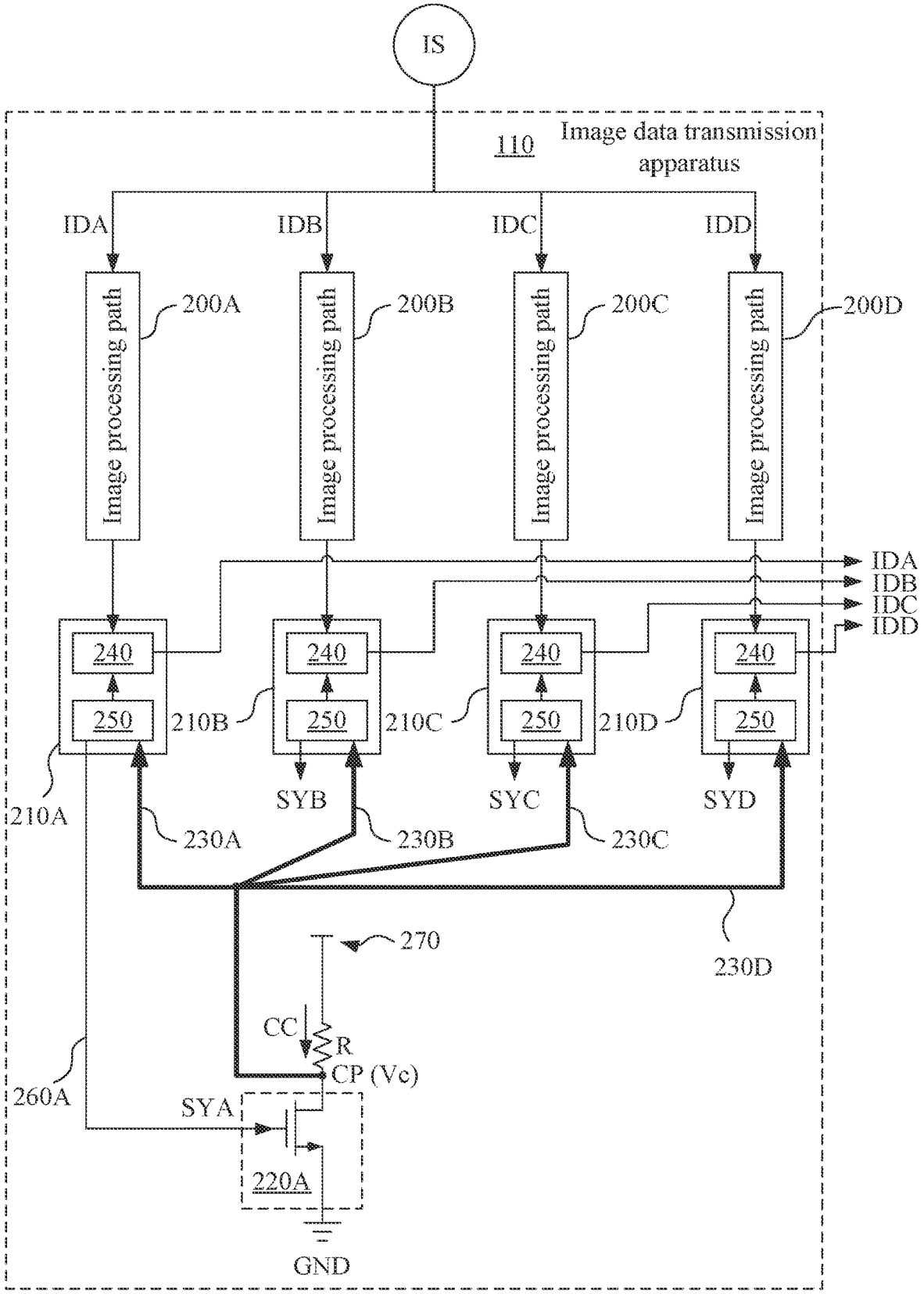
FIG. 2 illustrates a circuit diagram of the image data transmission apparatus having the synchronous data transmission mechanism according to an embodiment of the present invention.

Reference is now made to FIG. 2. FIG. 2 illustrates a circuit diagram of the image data transmission apparatus 110 having the synchronous data transmission mechanism according to an embodiment of the present invention.

As illustrated in FIG. 2, the image data transmission apparatus 110 includes a plurality of image processing paths 200A~200D, a plurality of output stage circuits 210A~210D, a primary switch circuit 220A and a plurality of voltage transmission paths 230A~230D.

Each of the image processing paths 200A~200D is electrically coupled between the image source IS and one of the output stage circuits 210A~210D. Each of the image processing paths 200A~200D is configured to receive one of the pieces of image data IDA-IDD from the image source IS to perform processing thereon and transmit the corresponding one of the pieces of image data IDA-IDD to one of the output stage circuits 210A~210D.

In an embodiment, each of the image processing paths 200A~200D includes a plurality of digital signal processing circuits (not illustrated) to perform processing on one of the pieces of image data IDA-IDD. The digital signal processing circuits may perform processing on such as, but not limited to data format conversion, scaling or a combination thereof on the corresponding one of the pieces of image data IDA-IDD.

Each of the output stage circuits 210A~210D is configured to receive and store one of the pieces of image data IDA~IDD processed by the image processing paths 200A~200D. In an embodiment, each of the output stage circuits 210A~210D includes a storage circuit 240 and a synchronization control circuit 250.

The storage circuit 240 of each of the output stage circuits 210A~210D is configured to receive and store one of the pieces of image data IDA~IDD. The synchronization control circuit 250 of each of the output stage circuits 210A~210D is configured to generate one of the frame aligning signals SYA~SYD, such that the primary switch circuit 220A adjusts a control voltage Vc of a control terminal CP according to one of the frame aligning signals SYA~SYD. In some embodiments, the time point that the synchronization control circuit 250 of each of the output stage circuits 210A~210D generates the frame aligning signals SYA~SYD can be a certain time point after the output stage circuits 210A~210D finishes receiving and storing the output stage circuits 210A~210D from the image source IS. In some embodiments, the time point that the synchronization control circuit 250 generates the frame aligning signals SYA~SYD can be a specific time point defined in the image data IDA~IDD.

Further, the synchronization control circuit 250 of each of the output stage circuits 210A~210D is electrically coupled to the control terminal CP through one of the voltage transmission paths 230A~230D, so as to synchronously output the image data IDA~IDD stored in the storage circuit 240 to the image data receiving apparatus 120 according to the control voltage Vc of the control terminal CP.

The primary switch circuit 220A is electrically coupled to a primary output stage circuit of the output stage circuits 210A~210D, so as to receive a primary frame aligning signal from the primary output stage circuit. In the present embodiment, the output stage circuit 210A is used as an example to serve as the primary output stage circuit. As a result, the primary switch circuit 220A is configured to receive the frame aligning signal SYA from the output stage circuit 210A. In other embodiments, the primary output stage circuit can be any one of the output stage circuits 210B~210D, and the primary switch circuit 220A can be configured to receive one of the frame aligning signals SYB~SYD that corresponds to the primary output stage circuit.

In an embodiment, the frame aligning signal SYA that serves as the primary frame aligning signal has the latest timing among all the frame aligning signals SYA~SYD. More specifically, the timing of the frame aligning signal SYA is behind the timings of all the frame aligning signals SYB~SYD.

In another embodiment, the primary switch circuit 220A is electrically coupled to the output stage circuit 210A through a primary transmission path 260A. The primary transmission path 260A may include a delay circuit (not illustrated) to guarantee that the timing that the frame aligning signal SYA received by the primary switch circuit 220A from the output stage circuit 210A through the primary transmission path 260A is behind the timings of all the frame aligning signals SYB~SYD.

When the primary switch circuit 220A does not receive the frame aligning signal SYA, the primary switch circuit 220A maintains the control voltage Vc of the control terminal CP at a first level. When the primary switch circuit 220A receives the frame aligning signal SYA, the primary switch circuit 220A switches the control voltage Vc of the control terminal CP from the first level to a second level.

In an embodiment, the control terminal CP receives a charging current CC from a power supply 270 (e.g. current source or voltage source) through a resistor R. The primary switch circuit 220A is electrically coupled between the control terminal CP and the ground terminal GND. The primary switch circuit 220A operates in a first status when the frame aligning signal SYA is not yet received thereby to maintain the control voltage Vc at the first level. The primary switch circuit 220A operates in a second status when the frame aligning signal SYA is received thereby to switch the control voltage Vc from the first level to the second level.

One of the first status and the second status is configured to turn on the primary switch circuit 220A to drain a current from the control terminal CP to pull down the control voltage Vc, and another one of the first status and the second status is configured to turn off the primary switch circuit 220A to stop draining the current from the control terminal CP to pull up the control voltage Vc.

For example, the primary switch circuit 220A may include such as, but not limited to a metal-oxide-semiconductor (MOS) transistor or a bipolar transistor. Take an N-type MOS transistor included in the primary switch circuit 220A as an example, the drain and the source thereof are respectively electrically coupled to the control terminal CP and the ground terminal GND. The gate thereof is controlled by the voltage that the output stage circuit 210A transmits through the primary transmission path 260A such that the N-type MOS transistor turns on when a high status voltage is received and turns off when a low status voltage is received.

Under such a condition, the frame aligning signal SYA is a low active signal. More specifically, when the primary switch circuit 220A receives a high status signal from the output stage circuits 210A, the frame aligning signal SYA is not yet received. As a result, the first status of the primary switch circuit 220A is "turn-on" to drain the current from the control terminal CP to pull down the control voltage Vc. In an embodiment, the ground level that the control voltage Vc is pulled to corresponds to the first level described above.

When the primary switch circuit 220A receives a low status signal from the output stage circuits 210A, the frame aligning signal SYA has been received. As a result, the second status of the primary switch circuit 220A is "turn-off" to stop draining the current from the control terminal CP. The control voltage Vc of the control terminal CP is therefore pulled up by the charging current CC from the power supply 270. In an embodiment, the high status voltage that the control voltage Vc is pulled to corresponds to the second level described above.

The voltage transmission paths 230A~230D are configured to electrically couple the control terminal CP to the synchronization control circuit 250 of each of the output stage circuits 210A~210D. Each of the voltage transmission paths 230A~230D is configured to have the same signal transmission time. As a result, when the control voltage Vc switches from the first level to a second level, the synchronization control circuit 250 of each of the output stage circuits 210A~210D synchronously receives the control voltage Vc having the second level through the voltage transmission paths 230A~230D.

Further, according to the control voltage Vc having the second level, the synchronization control circuit 250 synchronously outputs the image data IDA~IDD stored in the storage circuit 240 to the image data receiving apparatus 120 such that the image data receiving apparatus 120 displays the display frame accordingly.

Figure 3:
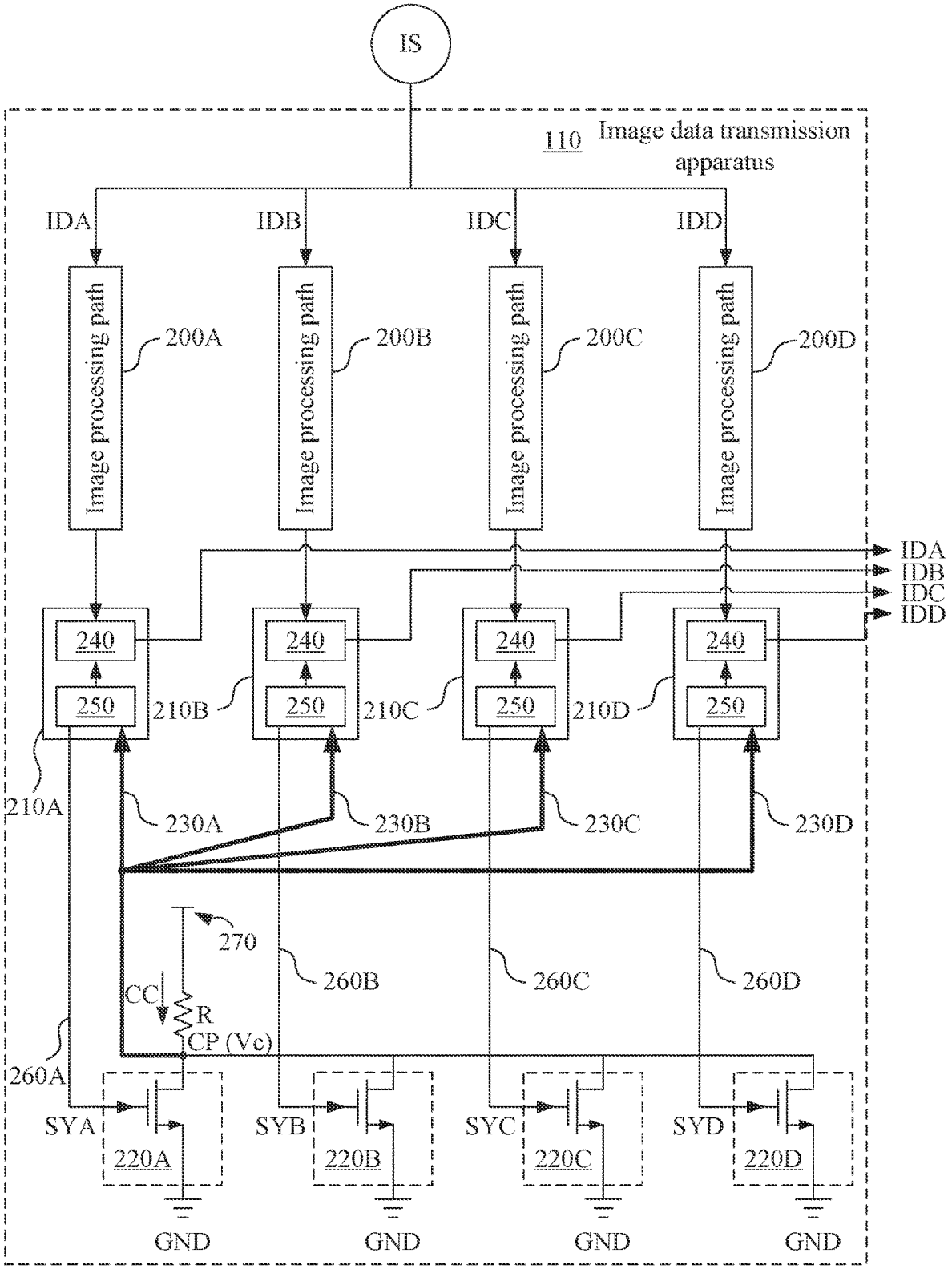
FIG. 3 illustrates a circuit diagram of the image data transmission apparatus having the synchronous data transmission mechanism according to another embodiment of the present invention.

Reference is now made to FIG. 3. FIG. 3 illustrates a circuit diagram of the image data transmission apparatus 110 having the synchronous data transmission mechanism according to another embodiment of the present invention.

Similar to the image data transmission apparatus 110 illustrated in FIG. 2, the image data transmission apparatus 110 illustrated in FIG. 3 also includes the image processing paths 200A~200D, the output stage circuits 210A~210D, the primary switch circuit 220A and the voltage transmission paths 230A~230D. The configuration and operation of these components are identical to those illustrated in FIG. 2. As a result, the detail is not described herein. In the present embodiment, the image data transmission apparatus 110 further includes a plurality of secondary switch circuits 220B~220D.

Each of the secondary switch circuits 220B~220D is electrically coupled to one of a plurality of secondary output stage circuits (the output stage circuits 210B~210D other than the primary output stage circuit 210A) through one of a plurality of secondary transmission paths. Each of the secondary switch circuits 220B~220D is configured to receive one of a plurality of secondary frame aligning signals from the one of the secondary output stage circuits. More specifically, each of the secondary switch circuits 220B~220D is electrically coupled to one of the output stage circuits 210B~210D through one of the secondary transmission paths 260B~260D to receive one of the frame aligning signals SYB~SYD from one of the output stage circuits 210B~210D.

Further, each of the secondary switch circuits 220B~220D is electrically coupled between the control terminal CP and the ground terminal GND.

Similar to the implementation and the operation of the primary switch circuit 220A, each of the secondary switch circuits 220B~220D may include a MOS transistor or a bipolar transistor. Each of the secondary switch circuits 220B~220D is configured to operate in the first status when a corresponding one of the frame aligning signals SYB~SYD is not received. Each of the secondary switch circuits 220B~220D is configured to operate in the second status when a corresponding one of the frame aligning signals SYB~SYD is received.

Take the condition that each of the secondary switch circuits 220B~220D is implemented by the N-type MOS transistor and each of the frame aligning signals SYB~SYD is a low active signal as an example, the first status is "turn-on" and the second status is "turn-off". As a result, when a corresponding one of the frame aligning signals SYB~SYD is not received, each of secondary switch circuits 220B~220D is configured to turn on to pull down the control voltage Vc of the control terminal CP. When a corresponding one of the frame aligning signals SYB~SYD is received, each of secondary switch circuits 220B~220D is configured to turn off to pull up the control voltage Vc of the control terminal CP.

In an embodiment, the timings of all the frame aligning signals SYB~SYD are ahead of the latest timing of the frame aligning signal SYA. As a result, when the frame aligning signal SYA is not received by the primary switch circuit 220A, the control voltage Vc of the control terminal CP is pulled down to be maintained at the first level due to the first status ("turn-on") of the primary switch circuit 220A even if all the secondary switch circuits 220B~220D turn off due to the reception of the frame aligning signals SYB~SYD. The control voltage Vc of the control terminal CP is pulled up to the second level due to the charging current CC of the power supply 270 only when the primary switch circuit 220A receives the frame aligning signal SYA and turns to the second status ("turn-off").

In an embodiment, the primary transmission path 260A and the secondary transmission paths 260B~260D can be selectively configured to have the same signal transmission time. As a result, the timings of the frame aligning signals SYA~SYD are only related to the time spots that the output stage circuits 210A~210D generate the frame aligning signals SYA~SYD and are irrelevant to the transmission path to the primary switch circuit 220A and the secondary switch circuits 220B~220D. However, in the present embodiment, no matter whether the primary transmission path 260A and the secondary transmission paths 260B~260D have the same signal transmission time, the timing for synchronous transmission corresponds to the latest timing of the frame aligning signal.

Subsequently, the voltage transmission paths 230A~230D having the same signal transmission time allow the synchronization control circuit 250 of each of the output stage circuits 210A~210D synchronously receives the control voltage Vc having the second level when the control voltage Vc switches from the first level to the second level. Further, the synchronization control circuit 250 synchronously outputs the image data IDA~IDD stored in the storage circuit 240 to the image data receiving apparatus 120 according to the control voltage Vc having the second level such that the image data receiving apparatus 120 displays the display frame accordingly.

As a result, the image data transmission apparatus of the present invention can use the frame aligning signal having the latest timing as the primary frame aligning signal to guarantee that all the output stage circuits are ready to output the image data. The primary switch circuit switches the status of the control voltage according to the primary frame aligning signal such that all the output stage circuits receives the control voltage having the switched status synchronously and output the image data synchronously to accomplish the accurate synchronous image data transmission mechanism.

It is appreciated that in the embodiments described above, the condition that the output stage circuits 210A generates the primary frame aligning signal is used as an example. In other embodiments, the primary frame aligning signal having the latest timing may correspond to other output stage circuits.

Further, under the appropriate adjustment of logic combination, each of the primary and secondary frame aligning signals can be selectively implemented by either a high active signal or a low active signal. Along with the primary and secondary frame aligning signals, each of the primary and secondary switch circuits can be selectively implemented by using a N-type MOS transistor, a P-type MOS transistor, a NPN bipolar transistor or a PNP bipolar transistor. The present invention is not limited to the implementation illustrated in FIG. 2 and FIG. 3.

Figure 4:
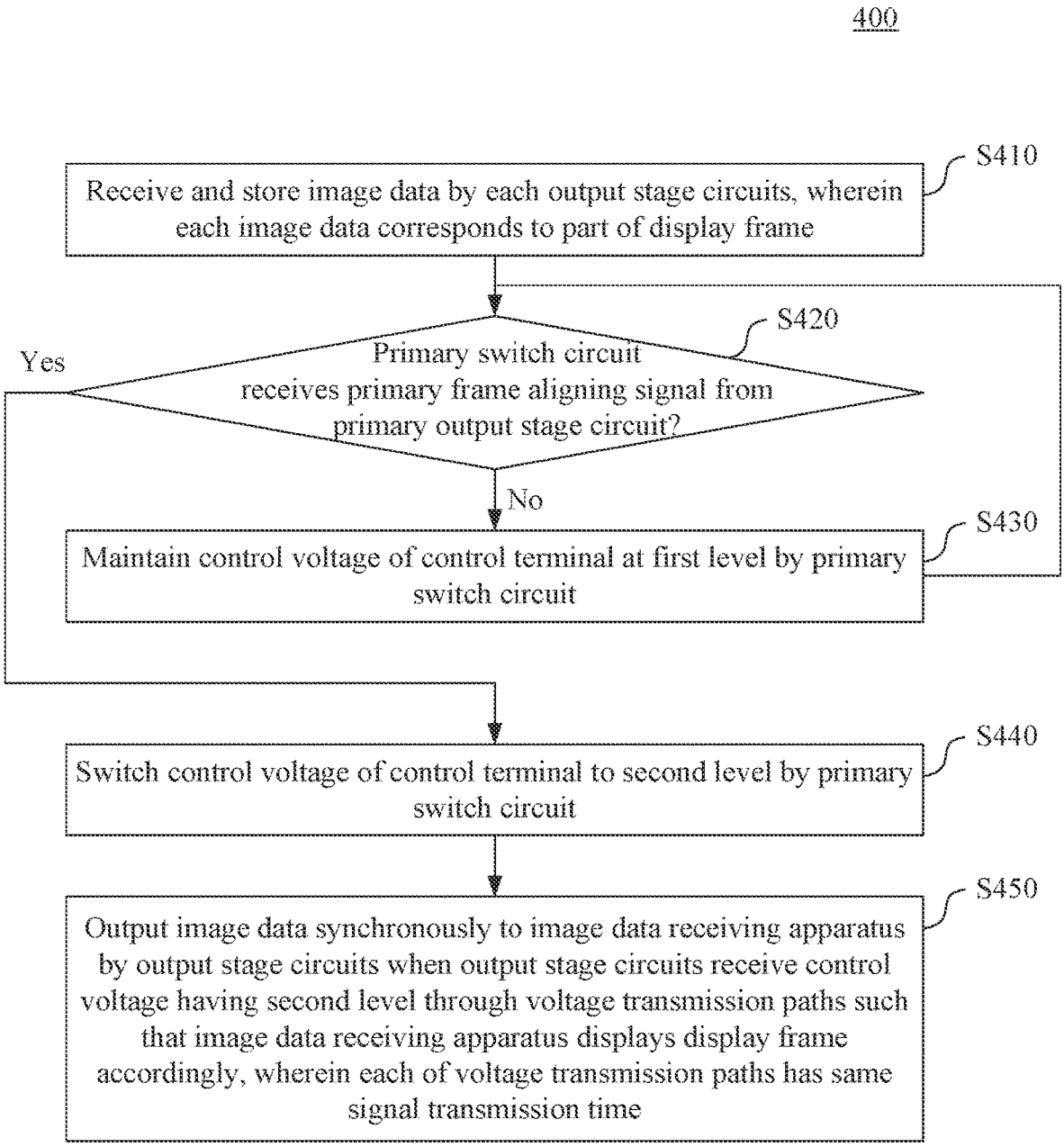
FIG. 4 illustrates a flow chart of an image data transmission method having synchronous data transmission mechanism according to an embodiment of the present invention.

Reference is now made to FIG. 4. FIG. 4 illustrates a flow chart of an image data transmission method 400 having synchronous data transmission mechanism according to an embodiment of the present invention.

Besides the apparatus described above, the present invention further discloses the image data transmission method 400 that can be used in such as, but not limited to the image data transmission apparatus 110 illustrated in FIG. 1. An embodiment of the image data transmission method 400 is illustrated in FIG. 4 and includes the steps outlined below.

In step S410, one of the pieces of image data IDA~IDD is received and stored by each of the output stage circuits 210A~210D, wherein each of the pieces of image data IDA~IDD corresponds to a part of a display frame.

In step S420, whether the primary frame aligning signal SYA having the latest timing is received from the primary output stage circuit 210A by the primary switch circuit 220A electrically coupled to the primary output stage circuit 210 of the output stage circuits 210A~210D, is determined.

In step S430, the control voltage Vc of the control terminal CP is maintained at the first level when the primary frame aligning signal SYA is not received by the primary switch circuit 220A from the primary output stage circuit 210A. Subsequently, the flow goes back to step S420 to keep performing determination.

In step S440, the control voltage Vc of the control terminal CP is switched from the first level to the second level when the primary frame aligning signal SYA is received by the primary switch circuit 220A from the primary output stage circuit 210A.

In step S450, the image data IDA~IDD is outputted synchronously to an image data receiving apparatus 120 by the output stage circuits 210A~210D when the output stage circuits 210A~210D receive the control voltage Vc having the second level through the voltage transmission paths 230A~230D such that the image data receiving apparatus 120 displays the display frame accordingly.

The voltage transmission paths 230A~230D are configured to electrically couple the control terminal CP to each of the output stage circuits 210A~210D and each of the voltage transmission paths 230A~230D has the same signal transmission time.

It is appreciated that the embodiments described above are merely an example. In other embodiments, it is appreciated that many modifications and changes may be made by those of ordinary skill in the art without departing, from the spirit of the invention.

In summary, the image display system and the image data transmission apparatus and method thereof having synchronous data transmission mechanism of the present invention can use the primary switch circuit to switch the status of the control voltage according to the primary frame aligning signal having the latest timing to synchronously drive the output stage circuits to output the image data. An accurate synchronous image data transmission mechanism is accomplished.

The aforementioned descriptions represent merely the preferred embodiments of the present disclosure, without any intention to limit the scope of the present disclosure thereto. Various equivalent changes, alterations, or modifications based on the claims of present disclosure are all consequently viewed as being embraced by the scope of the present disclosure.

What is claimed is:

1. An image data transmission apparatus having synchronous data transmission mechanism comprising:

a plurality of output stage circuits each configured to receive and store one of a plurality of pieces of image data, wherein each of the pieces of image data corresponds to a part of a display frame;

a primary switch circuit electrically coupled to a primary output stage circuit of the output stage circuits, and configured to maintain a control voltage of a control terminal at a first level when a primary frame aligning signal having a latest timing is not received thereby from the primary output stage circuit, and to switch the control voltage of the control terminal from the first level to a second level when the primary frame aligning signal is received; and a plurality of voltage transmission paths configured to electrically couple the control terminal to each of the output stage circuits and each of the voltage transmission paths has the same signal transmission time;

wherein when the output stage circuits receive the control voltage having the second level through the voltage transmission paths, the output stage circuits output the image data synchronously to an image data receiving apparatus such that the image data receiving apparatus displays the display frame accordingly.

2. The image data transmission apparatus of claim 1, wherein the control terminal receives a charging current from a power supply through a resistor and the primary switch circuit is electrically coupled between the control terminal and a ground terminal, such that the primary switch circuit operates in a first status when the primary frame aligning signal is not received and operates in a second status when the primary frame aligning signal is received to switch the control voltage to the second level;

wherein one of the first status and the second status is configured to turn on the primary switch circuit to drain a current from the control terminal to pull down the control voltage, and another one of the first status and the second status is configured to turn off the primary switch circuit to stop draining the current from the control terminal to pull up the control voltage.

3. The image data transmission apparatus of claim 2, wherein the primary switch circuit comprises a metal-oxide-semiconductor (MOS) transistor or a bipolar transistor.

4. The image data transmission apparatus of claim 2, further comprising a plurality of secondary switch circuits each electrically coupled to one of a plurality of secondary output stage circuits of the output stage circuits other than the primary output stage circuit;

wherein each of the secondary switch circuits is electrically coupled between the control terminal and the ground terminal, and is configured to operate in the first status when a corresponding one of a plurality of secondary frame aligning signals is not received from a corresponding one of the secondary output stage circuits, and operate in the second status when the corresponding one of the secondary frame aligning signals is received;

wherein a timing of each of the secondary frame aligning signals is ahead of the latest timing of the primary frame aligning signal.

5. The image data transmission apparatus of claim 4, wherein the primary switch circuit is electrically coupled to the primary output stage circuit through a primary transmission path, and each of the secondary switch circuits is electrically coupled to one of the secondary output stage circuits through one of a plurality of secondary transmission paths;

wherein the primary transmission path and the secondary transmission paths have the same signal transmission time.

6. The image data transmission apparatus of claim 4, wherein each of the secondary switch circuits comprises a MOS transistor or a bipolar transistor.

7. The image data transmission apparatus of claim 4, wherein each of the output stage circuits comprises:

a storage circuit configured to receive and store one of the pieces of the image data; and a synchronization control circuit configured to generate one of a plurality of frame aligning signal, and configured to output the image data stored in the storage circuit to the image data receiving apparatus when the control voltage having the second level is received thereby;

wherein the frame aligning signals comprise the primary frame aligning signal and the secondary frame aligning signals.

8. The image data transmission apparatus of claim 1, further comprising:

a plurality of image processing paths each electrically coupled between an image source and one of the output stage circuits, and each configured to receive one of the pieces of image data from the image source to perform processing thereon and transmit the one of the pieces of image data to one of the output stage circuits.

9. An image display system comprising:

an image data receiving apparatus; and an image data transmission apparatus comprising:

a plurality of output stage circuits each configured to receive and store one of a plurality of pieces of image data, wherein each of the pieces of image data corresponds to a part of a display frame;

a primary switch circuit electrically coupled to a primary output stage circuit of the output stage circuits, and configured to maintain a control voltage of a control terminal at a first level when a primary frame aligning signal having a latest timing is not received thereby from the primary output stage circuit, and to switch the control voltage of the control terminal from the first level to a second level when the primary frame aligning signal is received; and a plurality of voltage transmission paths configured to electrically couple the control terminal to each of the output stage circuits and each of the voltage transmission paths has the same signal transmission time;

wherein when the output stage circuits receive the control voltage having the second level through the voltage transmission paths, the output stage circuits output the image data synchronously to the image data receiving apparatus such that the image data receiving apparatus displays the display frame accordingly.

10. The image display system of claim 9, wherein the control terminal receives a charging current from a power supply through a resistor and the primary switch circuit is electrically coupled between the control terminal and a ground terminal, such that the primary switch circuit operates in a first status when the primary frame aligning signal is not received and operates in a second status when the primary frame aligning signal is received to switch the control voltage to the second level;

wherein one of the first status and the second status is configured to turn on the primary switch circuit to drain a current from the control terminal to pull down the control voltage, and another one of the first status and the second status is configured to turn off the primary switch circuit to stop draining the current from the control terminal to pull up the control voltage.

11. The image display system of claim 10, wherein the image data transmission apparatus further comprises a plurality of secondary switch circuits each electrically coupled to one of a plurality of secondary output stage circuits of the output stage circuits other than the primary output stage circuit;

wherein each of the secondary switch circuits is electrically coupled between the control terminal and the ground terminal, and is configured to operate in the first status when a corresponding one of a plurality of secondary frame aligning signals is not received from a corresponding one of the secondary output stage circuits, and operate in the second status when the corresponding one of the secondary frame aligning signals is received;

wherein a timing of each of the secondary frame aligning signals is ahead of the latest timing of the primary frame aligning signal.

12. The image display system of claim 11, wherein the primary switch circuit is electrically coupled to the primary output stage circuit through a primary transmission path, and each of the secondary switch circuits is electrically coupled to one of the secondary output stage circuits through one of a plurality of secondary transmission paths;

wherein the primary transmission path and the secondary transmission paths have the same signal transmission time.

13. The image display system of claim 11, wherein each of the output stage circuits comprises:

a storage circuit configured to receive and store one of the pieces of the image data; and a synchronization control circuit configured to generate one of a plurality of frame aligning signal, and configured to output the image data stored in the storage circuit to the image data receiving apparatus when the control voltage having the second level is received thereby;

wherein the frame aligning signals comprise the primary frame aligning signal and the secondary frame aligning signals.

14. The image display system of claim 9, further comprising:

a plurality of image processing paths each electrically coupled between an image source and one of the output stage circuits, and each configured to receive one of the pieces of image data from the image source to perform processing thereon and transmit the one of the pieces of image data to one of the output stage circuits.

15. An image data transmission method having synchronous data transmission mechanism applicable to an image data transmission apparatus, comprising:

receiving and storing one of a plurality of pieces of image data by each of a plurality of output stage circuits, wherein each of the pieces of image data corresponds to a part of a display frame;

maintaining a control voltage of a control terminal at a first level when a primary frame aligning signal having a latest timing is not received thereby from the primary output stage circuit by a primary switch circuit electrically coupled to a primary output stage circuit of the output stage circuits;

switching the control voltage of the control terminal from the first level to a second level when the primary frame aligning signal is received by the primary switch circuit; and outputting the image data synchronously to an image data receiving apparatus by the output stage circuits when the output stage circuits receive the control voltage having the second level through a plurality of voltage transmission paths such that the image data receiving apparatus displays the display frame accordingly, wherein the voltage transmission paths are configured to electrically couple the control terminal to each of the output stage circuits and each of the voltage transmission paths has the same signal transmission time.

16. The image data transmission method of claim 15, further comprising:

receiving a charging current from a power supply through a resistor by the control terminal, wherein the primary switch circuit is electrically coupled between the control terminal and a ground terminal;

operating the primary switch circuit in a first status when the primary frame aligning signal is not received; and operating the primary switch circuit in a second status when the primary frame aligning signal is received to switch the control voltage to the second level;

wherein one of the first status and the second status is configured to turn on the primary switch circuit to drain a current from the control terminal to pull down the control voltage, and another one of the first status and the second status is configured to turn off the primary switch circuit to stop draining the current from the control terminal to pull up the control voltage.

17. The image data transmission method of claim 16, wherein the image data transmission apparatus further comprises a plurality of secondary switch circuits each electrically coupled to one of a plurality of secondary output stage circuits of the output stage circuits other than the primary output stage circuit, each of the secondary switch circuits is electrically coupled between the control terminal and the ground terminal, and the image data transmission method further comprises:

operating the secondary switch circuits in the first status when a corresponding one of a plurality of secondary frame aligning signals is not received from a corresponding one of the secondary output stage circuits; and operating the secondary switch circuits in the second status when the corresponding one of the secondary frame aligning signals is received;

wherein a timing of each of the secondary frame aligning signals is ahead of the latest timing of the primary frame aligning signal.

18. The image data transmission method of claim 17, wherein the primary switch circuit is electrically coupled to the primary output stage circuit through a primary transmission path, and each of the secondary switch circuits is electrically coupled to one of the secondary output stage circuits through one of a plurality of secondary transmission paths;

wherein the primary transmission path and the secondary transmission paths have the same signal transmission time.

19. The image data transmission method of claim 17, further comprising:

receiving and storing one of the pieces of the image data by a storage circuit of each of the output stage circuits; and generating one of a plurality of frame aligning signal and outputting the image data stored in the storage circuit to the image data receiving apparatus by a synchronization control circuit of each of the output stage circuits when the control voltage having the second level is received thereby;

wherein the frame aligning signals comprise the primary frame aligning signal and the secondary frame aligning signals.

20. The image data transmission method of claim 15, further comprising:

receiving one of the pieces of image data from an image source to perform processing thereon and transmit the one of the pieces of image data to one of the output stage circuits by each of a plurality of image processing paths, wherein each of the image processing paths is electrically coupled between the image source and one of the output stage circuits.

* * * * *